US005624035A

United States Patent [19]

Kim

[11] Patent Number: 5,624,035

[45] Date of Patent: Apr. 29, 1997

[54] CARRYING CASE WITH INFLATABLE SECTIONS

[75] Inventor: Young S. Kim, Los Altos, Calif.

[73] Assignee: Inno Design, Inc., Palo Alto

[21] Appl. No.: 485,109

[22] Filed: Jun. 7, 1995

[51] Int. Cl.[6] ..... B65D 81/02

[52] U.S. Cl. ..... 206/522; 206/591; 206/521; 206/592

[58] Field of Search ..... 206/522, 591, 206/592, 521; 383/3; 229/87.02; D23/231, 232

[56] References Cited

U.S. PATENT DOCUMENTS

| | | | |
|---|---|---|---|
| D. 340,346 | 10/1993 | Phillips | D23/231 |
| 3,889,743 | 6/1975 | Presnick | 206/522 X |
| 4,091,852 | 5/1978 | Jordan et al. | 206/522 X |
| 4,826,329 | 5/1989 | Bellini | 383/3 |
| 4,905,835 | 3/1990 | Pivert et al. | 206/522 |
| 5,180,060 | 1/1993 | Forti et al. | 206/522 |
| 5,217,131 | 6/1993 | Andrews | 206/522 X |
| 5,263,587 | 11/1993 | Elkin et al. | 206/522 |
| 5,351,829 | 10/1994 | Bartsford | 206/522 |
| 5,469,966 | 11/1995 | Boyer | 206/522 |

*Primary Examiner*—David T. Fidei

*Attorney, Agent, or Firm*—Douglas A. Chaikin, Esq.; Peninsula IP Group

[57] ABSTRACT

Disclosed herein is carrying case for protecting items. The carrying case includes an enclosure assembly having various sections, an air valve, an air pump and an attachment mechanism. Each section foldably connects to an adjacent section so that the enclosure assembly can fold from an open configuration to a closed configuration. The attachment mechanism includes a strap for holding the carrying case in the closed configuration. The air valve attaches to at least one section to selectively regulate air pressure in the section.

19 Claims, 4 Drawing Sheets

CARRYING CASE WITH INFLATABLE SECTIONS

BACKGROUND OF THE INVENTION

1. Field of the Invention

The present invention relates generally to carrying cases that protect items during storage, handling and transport. More particularly, the present invention relates to carrying cases having inflatable sections.

2. Previous Art

Carrying cases are used for carrying various items such as luggage, electronic equipment, sports equipment and other breakable items. Carrying cases are optimally lightweight and durable. Various carrying cases have a padded interior to prevent items held within the carrying case from shifting and breaking. Other carrying cases having a rigid frame to inhibit the effects of direct impact and provide structural support to reduce the risk that item will be crushed or otherwise broken.

Carrying cases may include inserts. The inserts attach in the carrying case to inhibit movement of items within the carrying case. Inserts can have various geometric configurations depending on the shape and size of an item to be held within the carrying case. For example, a carrying case for a portable computer can have walls which define a rectangular interior for holding the portable computer. Inserts may also divide the interior into various sized portions. The various sized portions hold power chords, batteries and various computer components. Inserts protect items such as a portable computer and components by resisting movement and impact.

Inserts may be rigid or soft. Rigid inserts may be adapted in shape to hold a particular item such as a computer. Rigid inserts typically attach to walls of the carrying case. Such rigid inserts are designed to provide rigidity to the carrying case and to restrict movement of the item (e.g. a computer) in the carrying case. Rigid inserts may be made from folded card board, wood, plastic and other materials.

Rigid inserts have several drawbacks. Rigid inserts do not always conform to the shape of an item and allow the item to move during impact. Movement of an item can damage the item. Rigid inserts also may fail to protect an item from vibrations. Additionally, carrying cases having rigid inserts do not always adapt to hold different items such as electronic equipment of different sizes and shapes.

Soft inserts may conform in shape with an item held in the carrying case. Soft inserts may include padding such as foam, cloth, plastic and other materials. Foam padding traps air to cushion items against impact. Cloth padding may surround an item held in the carrying case to cushion the item against impact. The soft inserts assist in dampening vibrations and absorbing impact forces for protecting items during storage, handling and transport.

Soft inserts have several drawbacks. Soft inserts may not provide structural rigidity to a carrying case. Cases with soft inserts can often crush. Soft inserts often do not securely attach within the carrying case, permitting enclosed items to move relative to the carrying case. Such movement may damage the item.

What is desired is a carrying case which protects items by restricting movement of the items. What is also desired is carrying case which protects items by conforming in shape to the items and resisting impact.

SUMMARY OF THE INVENTION

Accordingly, it is an object of the invention to provide a carrying case which protects items by conforming in shape to an item.

It is another object to provide a carrying case which protects items by restricting movement of items within the carrying case.

In accordance with the above objects and those that will be mentioned and become apparent below, a carrying case for holding an item comprises:

an enclosure assembly, the enclosure assembly being divided into at least two inflatable sections, each section being foldably connected to an adjacent section for folding the enclosure assembly from an open configuration to a closed configuration, in the closed configuration the enclosure assembly defines a central portion for holding an item;

an air valve attached to at least one section to selectively regulate airflow into and out of the sections; and an attachment mechanism attachable between sections for maintaining the enclosure assembly in the closed configuration, whereby, when the enclosure assembly is in the closed configuration, the attachment mechanism attaches between the sections and maintains the enclosure assembly in the closed configuration, the air valve regulates air flows into the sections to inflate the sections.

In a preferred embodiment, the carrying case is includes air interconnect conduits for fluid interconnection of more than one section with an adjacent section. The sections communicate and air may pass from one section to another section to conform the carrying case to the items so packaged.

In another preferred embodiment, the carrying case has multiple air valves that regulate air pressure. The sections are independently inflatable. An air valve attaches to each section of the enclosure assembly to regulate air pressure in each section independently.

In another preferred embodiment, the carrying case has a base, four walls and a top which define discrete sections of the enclosure assembly. The base is generally rectangular shaped. The sections foldably connect to form a rectangular box shape when the carrying case is in the closed configuration.

In another preferred embodiment, the sections of the enclosure assembly are generally triangular shaped.

In another preferred embodiment, the carrying case has an inner periphery. The inner periphery being circular shaped for attachment over an item.

In another preferred embodiment, the enclosure assembly has a center. The sections foldably connect at the center.

In another preferred embodiment, each section has an external periphery which is attachable to the open end of a golf bag.

In another preferred embodiment, the enclosure assembly includes multiple partition walls which form partitions. The partition walls define holes to facilitate airflow between the partitions.

In another preferred embodiment, at least one section includes a pump and a pump tube, the pump has bellows and a frame, the pump tube connects with the air valve for delivering air from the pump to the enclosure assembly.

It is an advantage of the invention to provide a carrying case which conforms to the shape of an item.

It is another advantage to provide a carrying case which restricts movement of items within the carrying case.

The foregoing objects, advantages and features of the invention and those which will be apparent below can be better appreciated after review of the following detailed description of the invention in which like parts have like reference numerals, taken together with the drawing figures, in which:

DETAILED DESCRIPTION OF THE INVENTION

Figure 1:
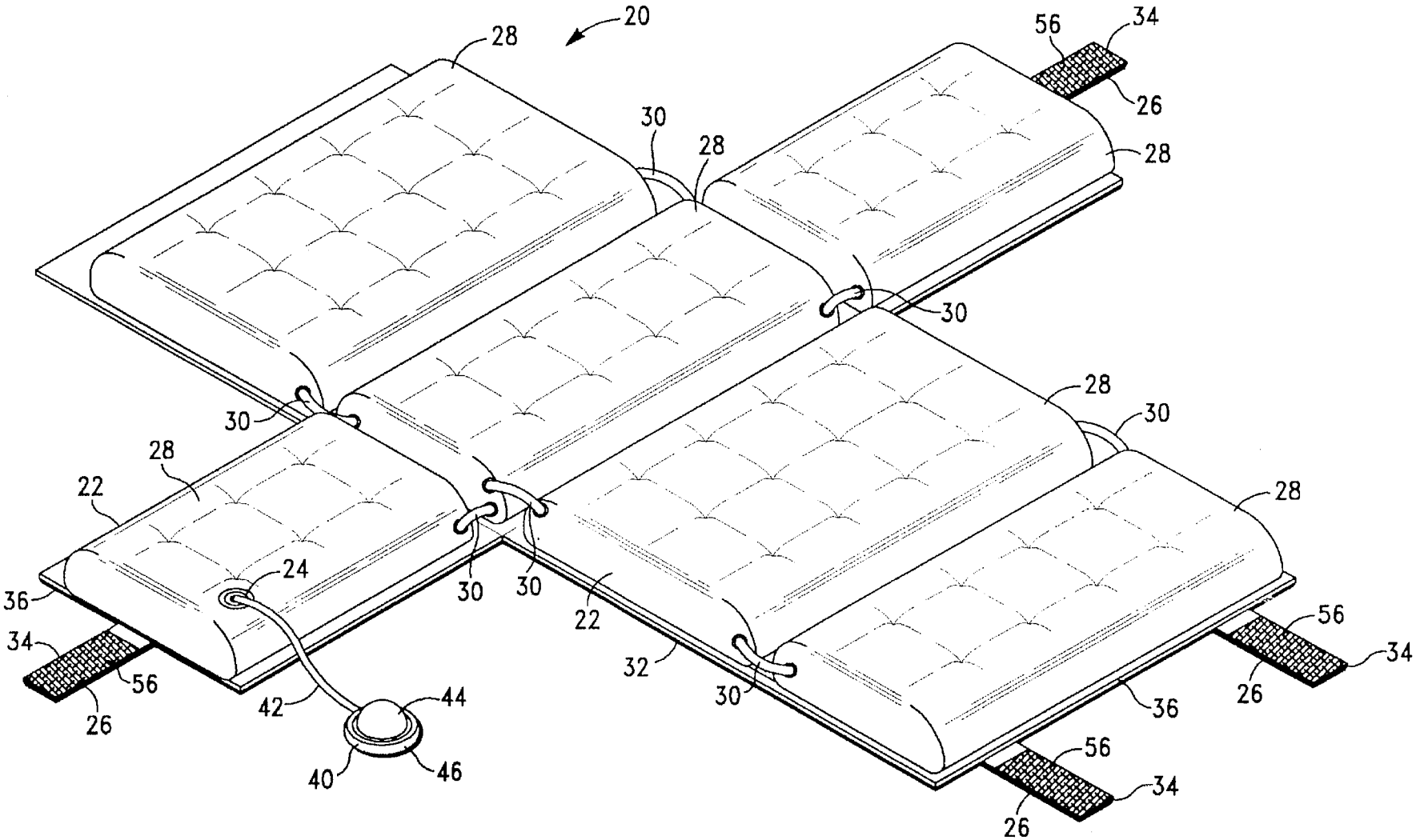
FIG. 1 is a perspective view of a carrying case in accordance with the present invention in an open configuration.

With particular reference to FIG. 1, there is shown a carrying case generally designated with the reference numeral 20. The carrying case 20 is in an open configuration. The carrying case 20 includes an enclosure assembly 22. The enclosure assembly 22 has a frame 32, an air valve 24, and several attachment mechanisms 26. The carrying case 20 folds between the open configuration and a closed configuration. The attachment mechanism 26 attaches to the enclosure assembly 22 to maintain the closed configuration. The air valve 24 facilitates selective inflation and deflation of the enclosure assembly 22.

The enclosure assembly 22 includes a plurality of sections 28 and air interconnect conduits 30. Each section 28 of the enclosure assembly 22 attaches to at least one interconnect conduit 30. The interconnect conduits 30 connect between adjacent sections 28 to communicate air between each section 28 and an adjacent section 28. The sections 28 are inflatable.

The enclosure assembly 22 attaches to the frame 32 to form an integrated structure. The frame 32 folds. The sections 28 foldably interconnect. The frame 32 is rigid and folds to fold the sections 28.

The air valve 24 attaches to one section 28 of the enclosure assembly 22. The air valve 24 is attachable to a pump tube 42 for inflating the enclosure assembly 22. The air valve 24 opens to receive air from a pump tube 42 to inflate the enclosure assembly 22. The air valve 24 selectively seals to inhibit the escape of air from the enclosure assembly 22. The air valve 24 selectively releases air from the enclosure assembly 22 to regulate pressure in the enclosure assembly 22.

A pump 40 attaches in fluid communication to the pump tube 42. In one embodiment of the present invention, the pump tube 42 removeably attaches to the air valve 24. In another embodiment, the pump tube 42 permanently attaches to the air valve 24.

The pump 40 includes a bellows 44 and a frame 46. The bellows 44 is semi-spherical shaped and compressible. The frame 46 is annular in shape to surroundingly engage the bellows 44. The bellows 44 mounts on the frame 46. The bellows 44 compresses against the frame 46 and urges air through the pump tube 42. Air urged through the pump tube 42 by the bellows 44 enters the enclosure assembly 22. The bellows 44 is fabricated from a material durable enough to endure compression due to foot and hand pressure from a user. In one embodiment, the bellows 44 is fabricated from plastic.

The attachment mechanisms 26 attach to a respective section 28 of the enclosure assembly 22. The attachment mechanisms 26 each include a strap 34. The frame 32 has a periphery 36. The straps 34 extend perpendicularly outwards from the respective sections 28, beyond the periphery 36 of the enclosure assembly 22. The straps 34 each have a Velcro® patch 56 which attaches to at least one end of each strap 34. The attachment mechanisms 26 are attachable to respective opposing portions of the enclosure assembly 22.

The frame 32 is fabricated from a rigid material which resists moisture. The frame 32 is formed in sections which correspond to each section 28 of the enclosure assembly 22. The sections of the frame 32 foldably interconnect. In one embodiment, the frame 32 is fabricated from a polyester fabric which attaches to a rigid polyurethane backing.

Figure 2:
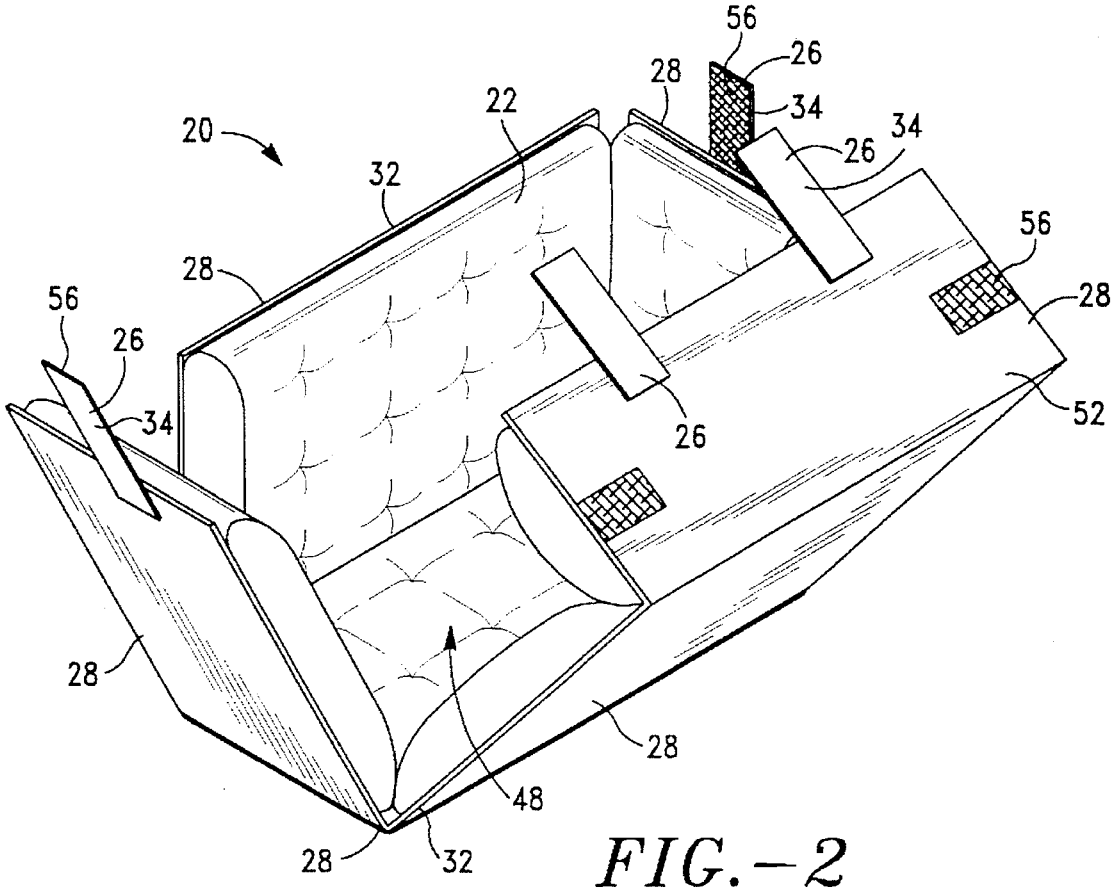
FIG. 2 is a perspective view of the carrying case of FIG. 1 in a partially closed configuration.

With particular reference to FIG. 2, there is shown the carrying case 20. The frame 32 folds. The sections 28 fold with the frame 32 to configure the carrying case 20 into a partially closed configuration.

The carrying case 20 has an exterior 52 and a Velcro® patch 56. The attachment mechanisms 26 include straps 34. Each strap 34 has a Velcro® patch 56. The Velcro® patch 56 of the exterior 52 is adjustably attachable to a corresponding Velcro® patch 56 of the strap 34. The straps 34 flex and are capable of extending from a section 28 to an opposing section 28 of the enclosure assembly 22 when the carrying case 20 is in the closed configuration (FIG. 3).

It can be appreciated that when the sections 28 fold that the sections 28 define a central portion generally designated 48. The central portion 48 is generally box shaped and conforms to the shape of an item (not shown) for holding and protecting the item.

Although an attachment mechanism 26 in the form of a strap 34 with a Velcro® patch 56 is disclosed, it can be appreciated that various attachment mechanism 26 types can be used to attach sections 28 together and hold the carrying case in a closed configuration. For example, the attachment mechanism 26 can include a zipper, buttons, snaps and any of a number of other connectors.

Figure 3:
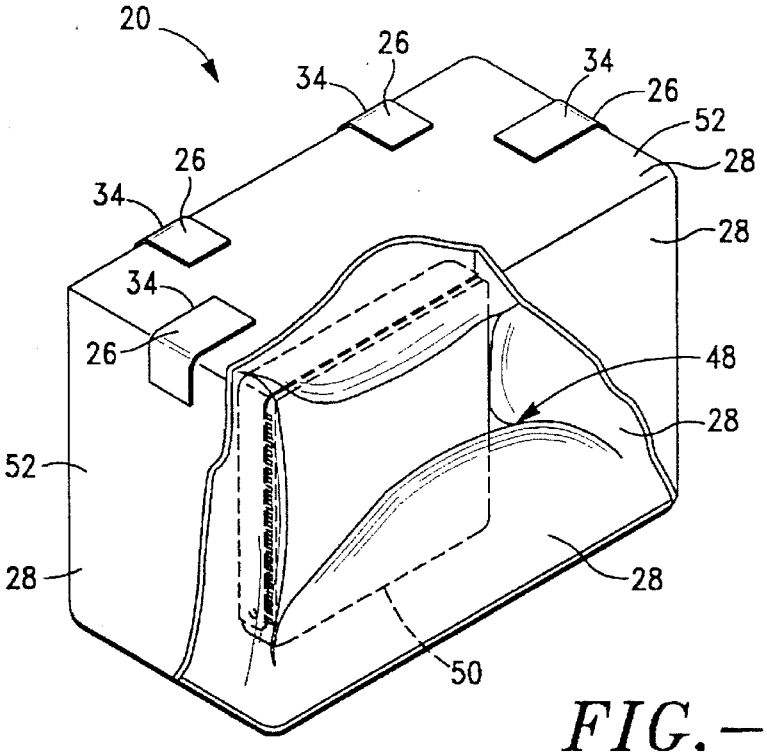
FIG. 3 is a partially cutaway perspective view of the carrying case of FIG. 2 in a closed configuration.

With particular reference to FIG. 3, there is shown the carrying case 20 in the closed configuration. The carrying case 20 has a rectangular box shape to enclose an item 50. The item 50 is a portable computer having a generally rectangular shape.

Each attachment mechanism 26 grips the exterior 52 to hold the carrying case 20 in the closed configuration. The attachment mechanisms 26 are configured to adjustably hold the carrying case 20 in the closed configuration to inhibit movement of items held in the central portion 48. The enclosure assembly 22 is adjustably inflatable to conform to the shape of items held in the central portion 48.

In one embodiment, each section 28 is independently inflatable to conform to the shape of the item 50 and to securely hold the item 50 within the carrying case 50.

It can be appreciated that the carrying case 20 can be adapted having a geometry to accommodate a variety of items such as electronic equipment, sports equipment and various breakable items. Examples of electronic equipment include a camera, a video recorder, a portable fax, a portable computer, etc. Examples of sports equipment include a racquet, a gun, golf clubs, etc. Breakable items can include mirrors, glass and picture frames, for example. Numerous items can be simultaneously enclosed within the carrying case 20. The carrying case 20 be adapted to either fully or partially enclose items.

Figure 4:
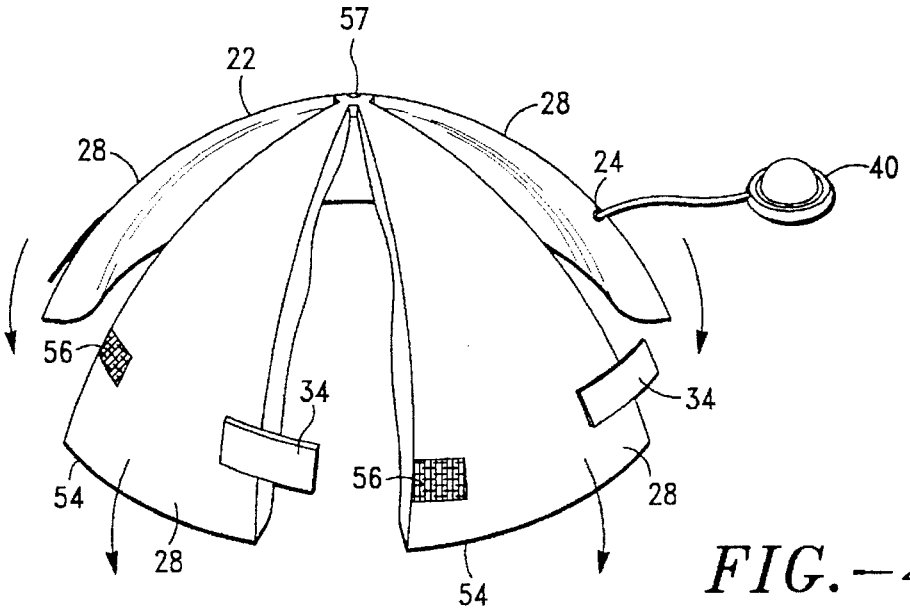
FIG. 4 is a perspective view of an enclosure assembly in accordance with the present invention.

With particular reference to FIG. 4, there is shown an embodiment of the carrying case 20. The carrying case 20 is in the open configuration. The carrying case 20 has an enclosure assembly 22 with four sections 28. The sections 28 are generally triangular shaped having an arcuate periphery 54. The sections 28 have uniform shapes. The air pump 40 pressurizes the enclosure assembly 22 to conform the enclosure assembly in shape to the shape of a item. The periphery 54 is attachable over a item. One strap 34 attaches to each section 28. Each section 28 has a Velcro® patch 56 which is attachable to a respective strap of an adjacent section 28.

In one embodiment, the sections 28 are triangular in shape. The periphery 54 of each section is linear to form a portion of the triangle shape. The sections 28 flex to conform to in shape to an item to be packaged.

It can be appreciated that the shape of each section 28 can vary to conform to the shape of an item to be packaged. In one embodiment, the sections 28 are non-uniform in shape.

The carrying case 20 has a center 57. The arcuate periphery 54 has a center of curvature which coincides with the center 57. The center 57 interconnects each section 28 of the enclosure assembly 22. The sections 28 bend adjacent the center 57 to facilitate movement of the carrying case 20 from the open configuration to a closed configuration.

Figure 5:
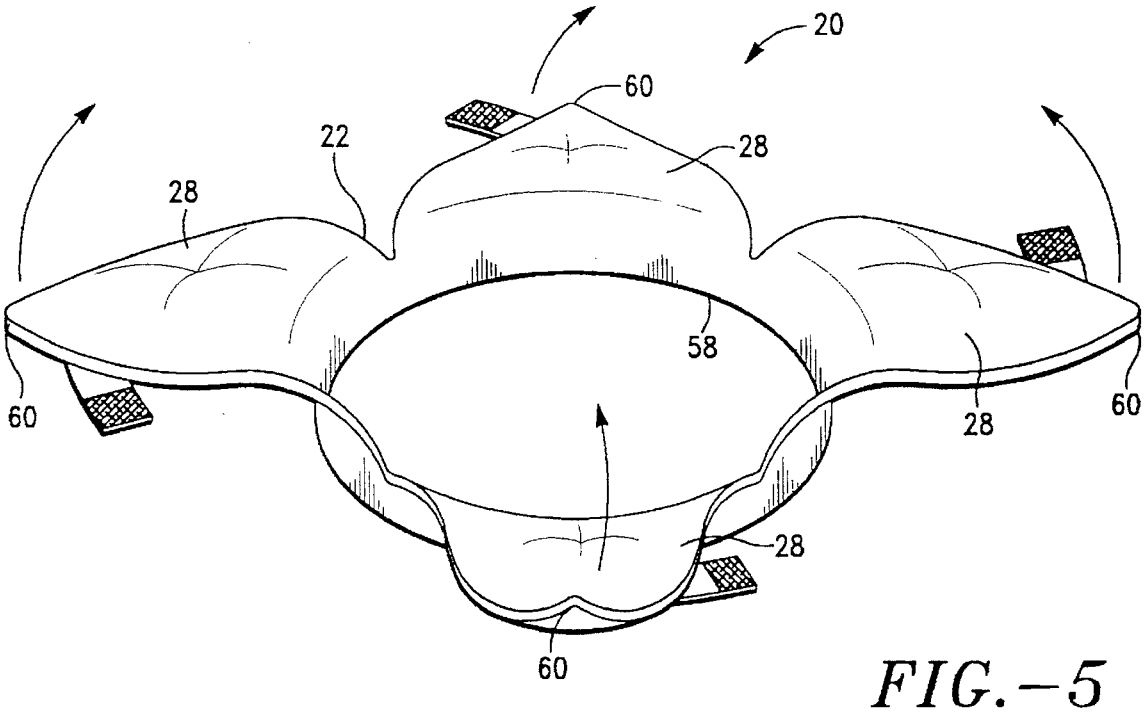
FIG. 5 is a perspective view of an enclosure assembly in accordance with the present invention.

With particular reference to FIG. 5, there is shown an embodiment of the enclosure assembly 22. The enclosure assembly 22 has an inner periphery 58. The inner periphery 58 is circular in shape for attachment over a portion of a cylindrical shaped container. The sections 28 of the enclosure assembly 28 are generally triangular shaped. Each section 28 has a tip 60. Each tip 60 extends radially from the inner periphery 58 when the carrying case 20 is in the open configuration. The tips 60 interconnect when the carrying case 20 into the closed configuration.

Figure 6:
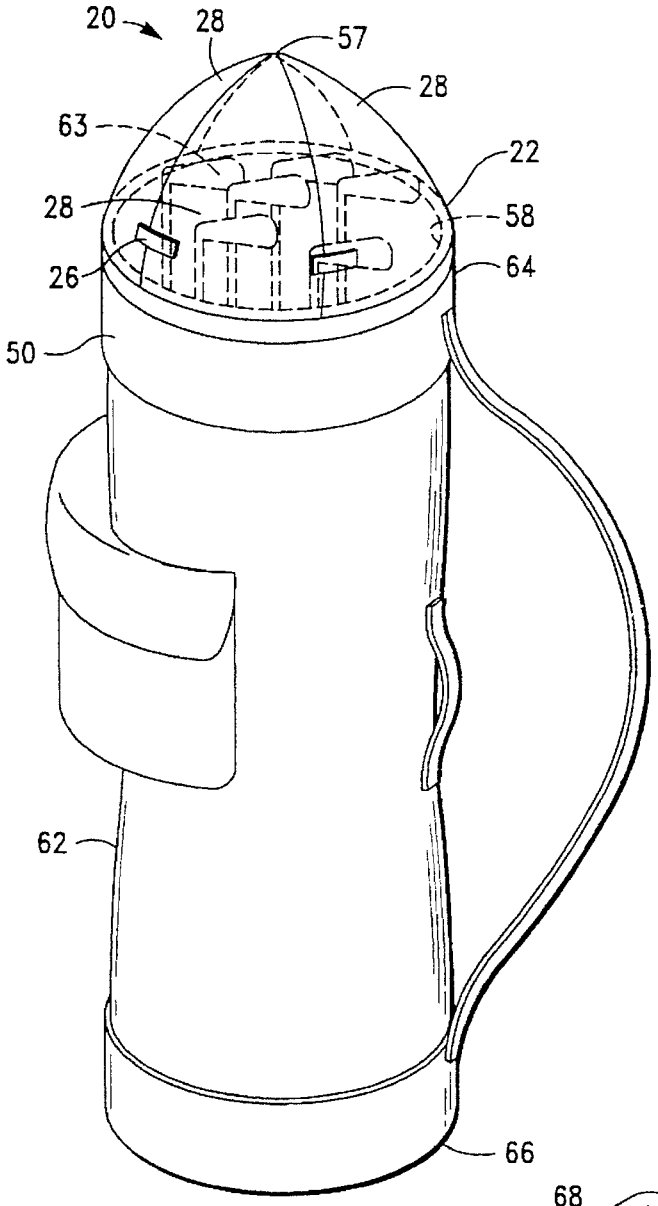
FIG. 6 is a perspective view of a carrying case including a golfbag and the enclosure assembly of FIG. 5.

With particular reference to FIG. 6, there is shown the carrying case 20. The carrying case 20 includes a golf bag 62. The golf bag 62 includes items such as golf clubs 63. The golf bag 62 has an open end 64 for receiving golf clubs, and a closed end 66. The inner periphery 58 of the enclosure assembly 22 flexes to attach around the open end 64 of the golf bag 62. The enclosure assembly 22 inflates to hold the golf clubs 63 immobile. The attachment mechanisms 26 hold each section 28 together.

Figure 7:
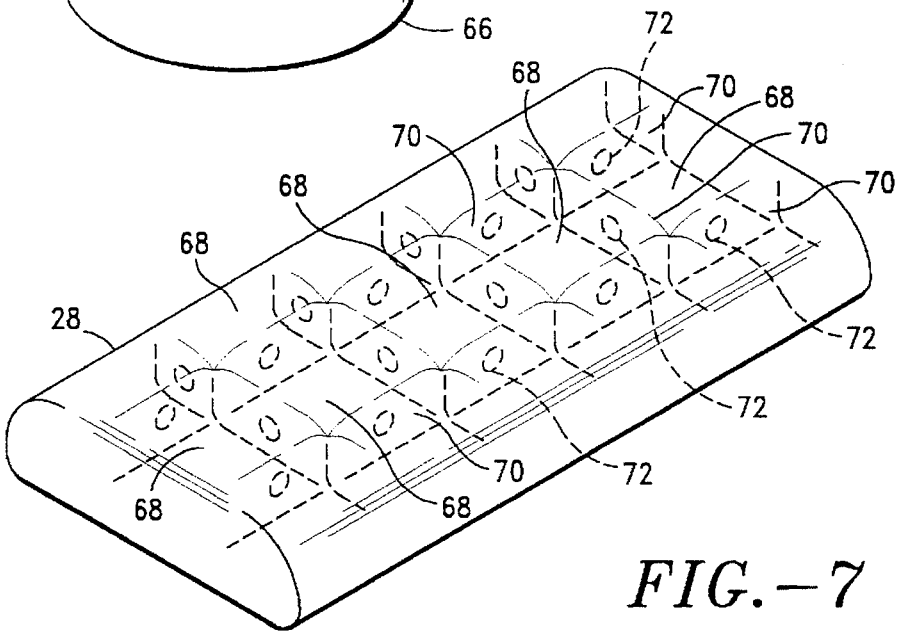
FIG. 7 Is a perspective view of an embodiment of a section of the carrying case of FIG. 1.

With particular reference to FIG. 7, there is shown an embodiment of a section 28 of the enclosure assembly 22 (FIG. 1). The section 28 includes multiple partitions 68. Each partition includes partition walls 70. The partition walls 70 provide the section 28 with structural rigidity and dampen air flow between partitions 68. Various partition walls 70 include air holes 72 to regulate the flow of air between partitions 68. The shape, size and positioning of each partition 68 can vary to be adapted to conform to the shape of an item.

It should further be apparent to those skilled in the art that various changes in form can be made to the above described invention. It is intended that such changes be included within the spirit and scope of the claims appended hereto. For example, the enclosure assembly can have sections of various shapes. The sections can interconnect by a variety of ways such as a mechanical hinge, or a resilient strip. The air pump can be self contained, or separate from the enclosure assembly. The attachment mechanism can include any number of conventional means for attaching sections together.

What is claimed is:

1. A carrying case for holding an item comprises:

an enclosure assembly, the enclosure assembly being divided into at least two inflatable sections, each section being foldably connected to an adjacent section for folding the enclosure assembly from an open configuration to a closed configuration, in the closed configuration the enclosure assembly defining a central portion for holding an item;

a foldable frame attached to the enclosure assembly, the frame being formed in sections corresponding to each section of the enclosure assembly, the sections of the enclosure assembly fold with the sections of the frame to close the enclosure assembly;

an air valve attached to at least one section to selectively regulate airflow into and out of the sections; and an attachment mechanism attachable between sections for maintaining the enclosure assembly in the closed configuration, whereby, when the enclosure assembly is in the closed configuration, the attachment mechanism attaches between the sections and maintains the enclosure assembly in the closed configuration, the air valve regulates air flow into the sections to inflate the sections.

2. A carrying case as set forth in claim 1, wherein the carrying case includes air interconnect conduits which interconnect each section in fluid communication with an adjacent section to maintain uniform air pressure throughout the enclosure assembly.

3. A carrying case as set forth in claim 1, wherein the carrying case has a base, four walls and a top which define discrete sections of the enclosure assembly, the base is generally rectangular shaped, the sections foldably connect to form a rectangular box shape when the carrying case is in the closed configuration.

4. A carrying case as set forth in claim 1, wherein the sections of the enclosure assembly are generally triangular shaped.

5. A carrying case as set forth in claim 4, wherein the carrying case has an inner periphery, the inner periphery being circular shaped for attachment over an item.

6. A carrying case as set forth in claim 4, wherein the enclosure assembly has a center, the sections interconnect at the center.

7. A carrying case as set forth in claim 6, wherein each section has an external periphery which is attachable to the open end of a golf bag.

8. A carrying case for holding an item comprises:

an enclosure assembly, the enclosure assembly being divided into at least two inflatable sections, each section being foldably connected to an adjacent section for folding the enclosure assembly from an open configuration to a closed configuration, in the closed configuration the enclosure assembly defines a central portion for holding an item;

a partition wall included within each section to form partitions which regulate airflow within each section, each partition wall has a hole to facilitate air flow through the partitions;

an air valve attached to at least one section to selectively regulate airflow into and out of the sections; and an attachment mechanism attachable between sections for maintaining the enclosure assembly in the closed configuration, whereby, when the enclosure assembly is in the closed configuration, the attachment mechanism attaches between the sections and maintains the enclosure assembly in the closed configuration, the air valve regulates air flow into the sections to inflate the sections.

9. A carrying case as set forth in claim 1, wherein at least one section includes a pump and a pump tube, the pump has bellows and a frame, the pump tube connects with the air valve for delivering air from the pump to the enclosure assembly.

10. A carrying case for protecting items, comprising:

an enclosure assembly, the enclosure assembly being divided into at least two sections, each section being foldably connected to an adjacent section for folding the enclosure assembly from an open configuration to a closed configuration, each section having at least one partition wall to regulate air flow within each section;

an air interconnect conduit attached in fluid communication between each section and an adjacent section to facilitate air flow between the sections;

an air valve attached to at least one section to selectively regulate air pressure in the enclosure assembly;

a pump attachable to the air valve; and a strap for attaching the sections together for defining and maintaining the closed configuration, whereby, when the enclosure assembly is folded in the closed configuration, the sections are attached by the strap for maintaining the enclosure assembly in the closed configuration, the pump and the air valve regulate air pressure in the enclosure assembly.

11. A carrying case as set forth in claim 10, wherein the carrying case has an arcuate periphery and a center, the center interconnects each section of the enclosure assembly, the sections bend adjacent the center to facilitate movement of the carrying case from the open configuration to a closed configuration.

12. A carrying case as set forth in claim 10, wherein the carrying case has an exterior and a central portion, the attachment mechanism adjustably grips the exterior to hold the carrying case in the closed configuration to inhibit movement of items held in the central portion.

13. A carrying case as set forth in claim 10, wherein each strap includes a hook and loop means for attachment to another section to hold the enclosure assembly in the closed configuration.

14. A carrying case as set forth in claim 10, wherein the pump has a pump tube, the pump includes a bellows and a frame, the bellows is semi-spherical shaped and compressible, the frame is annular in shape to surroundingly engage the bellows, the bellows mounts on the frame and compresses against the frame to urge air through the pump tube and into the enclosure assembly via the air valve.

15. A carrying case as set forth in claim 14, wherein the pump tube removeably attaches to the air valve.

16. A carrying case comprising:

a golf bag for holding golf clubs, the golf bag has an open end for receiving golf clubs and a closed end;

an enclosure assembly, the enclosure assembly being divided into at least two sections, each section being foldably connected to an adjacent section to fold the enclosure assembly from an open configuration to a closed configuration, the enclosure assembly being capable of attachment to the golf bag for covering the open end of the golf bag when the enclosure assembly folds into the closed configuration, the enclosure assembly is inflatable to immobilize the golf clubs when the enclosure assembly attaches to the golf bag;

each section having at least one partition wall to regulate air flow within each section;

an air interconnect conduit attached in fluid communication between each section and an adjacent section to facilitate air flow between the sections;

an air valve attached to at least one section to selectively regulate airflow into and out from the enclosure assembly; and an attachment mechanism attachable between sections, the attachment mechanism attaches between sections when the enclosure assembly is in the closed configuration for maintaining the enclosure assembly in the closed configuration, whereby, when the enclosure assembly folds in the closed configuration, the attachment mechanism attaches between sections to maintain the enclosure assembly in the closed configuration and to attach the enclosure assembly to the golf bag, and the valve regulates airflow into and out from the enclosure assembly.

17. A carrying case as set forth in claim 16, wherein the carrying case has an inner periphery, the inner periphery flexes to attach around the open end of the golf bag.

18. A carrying case as set forth in claim 16, wherein the enclosure assembly has an internally defined periphery, the internal periphery is shaped to surroundingly engage the open end of the golf bag.

19. A carrying case as set forth in claim 16, wherein the enclosure assembly includes a pump attached in fluid communication with the air valve.

* * * * *